US007178347B2

(12) United States Patent
Taira et al.

(10) Patent No.: US 7,178,347 B2
(45) Date of Patent: Feb. 20, 2007

(54) METHOD FOR REFRIGERANT AND OIL COLLECTING OPERATION AND REFRIGERANT AND OIL COLLECTION CONTROLLER

(75) Inventors: Shigeharu Taira, Kusatsu (JP); Junichirou Tanaka, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 543 days.

(21) Appl. No.: 10/258,793

(22) PCT Filed: Apr. 25, 2001

(86) PCT No.: PCT/JP01/03550

§ 371 (c)(1),
(2), (4) Date: Jan. 21, 2003

(87) PCT Pub. No.: WO01/84064

PCT Pub. Date: Nov. 8, 2001

(65) Prior Publication Data

US 2004/0168446 A1 Sep. 2, 2004

(51) Int. Cl.

| | |
|---|---|
| ***F25B 43/02*** | (2006.01) |
| ***F25B 47/00*** | (2006.01) |
| ***F25B 43/00*** | (2006.01) |
| ***F25B 43/04*** | (2006.01) |

(52) U.S. Cl. ..... 62/84; 62/85; 62/474; 62/475; 62/468

(58) Field of Classification Search ..... 62/84, 62/85, 472, 474, 475, 149, 159, 468; 134/22.11, 134/105, 107

See application file for complete search history.

(56) References Cited

U.S. PATENT DOCUMENTS

| | | | | |
|---|---|---|---|---|
| 3,948,679 | A * | 4/1976 | Lewis | 134/10 |
| 4,175,614 | A * | 11/1979 | Huggins | 165/95 |
| 4,474,034 | A | 10/1984 | Avery, Jr. | |
| 4,505,758 | A * | 3/1985 | Carson | 134/1 |
| 5,638,690 | A | 6/1997 | Berglöf | |
| 5,689,962 | A * | 11/1997 | Rafalovich | 62/90 |
| 5,727,396 | A * | 3/1998 | Boyd et al. | 62/323.1 |
| 5,806,329 | A * | 9/1998 | Taira et al. | 62/149 |
| 6,164,080 | A * | 12/2000 | Mika et al. | 62/85 |

FOREIGN PATENT DOCUMENTS

| | | |
|---|---|---|
| EP | 0 787 958 A | 8/1997 |
| EP | 0 852 324 A | 7/1998 |

(Continued)

*Primary Examiner*—William C. Doerrler
(74) *Attorney, Agent, or Firm*—Birch, Stewart, Kolasch, and Birch, LLP

(57) ABSTRACT

A method for refrigerant and oil collecting operation capable of assuring the cleanliness of the inside of an existing communication pipe at a low cost and installing, at a low cost, a new air conditioner, comprising a compressor (1), a heat source side heat exchanger (3), a decompressing mechanism (4), and a user side heat exchanger (5), comprising the steps of performing a pipe heating operation in a heating operation mode and performing a refrigerant and oil collecting operation to collect refrigerant to a heat source side heat exchanger (3), namely, with the refrigerant heated to a temperature higher than that where contaminants such as refrigerator oil inside a refrigerant circuit is dissolved into the refrigerant, performing the refrigerant and oil collecting operation so as to assure the cleanliness of the inside of the existing communication pipes (7, 8).

11 Claims, 5 Drawing Sheets

FOREIGN PATENT DOCUMENTS

| | | | | |
|---|---|---|---|---|
| EP | 0 952 407 A2 | | 10/1999 | |
| JP | 2-140574 | * | 5/1990 | ..... 62/125 |
| JP | 9-152233 A | | 6/1997 | |
| JP | 9-250850 A | | 9/1997 | |
| JP | 2000-55514 A | | 2/2000 | |

* cited by examiner

METHOD FOR REFRIGERANT AND OIL COLLECTING OPERATION AND REFRIGERANT AND OIL COLLECTION CONTROLLER

This application is the national phase under 35 U.S.C. § 371 of PCT International Application No. PCT/JP01/03550 which has an International filing date of Apr. 25, 2001, which designated the United States of America.

TECHNICAL FIELD

This invention relates to a refrigerant and oil collection operating method, and in particular, to a refrigerant and oil collection operating method and refrigerant and oil collection control device, which can restrain the occurrence of various troubles when the existing interconnecting piping is reused by effectively collecting the contaminants of a residual refrigerating machine oil, oils other than the refrigerating machine oil, moisture, air, wear metal powders, dust and so on in the existing interconnecting piping together with the refrigerant.

BACKGROUND ART

Since the Freon-based refrigerants have been subject to the chlorofluorocarbon control, an HFC-based refrigerant has become used as an alternative refrigerant. This HFC-based refrigerant contains no chlorine atom in the molecular structure thereof, and therefore, the lubrication performance of the compressor is reduced. Moreover, the HFC-based refrigerant, which structurally has a strong polarity, has the properties that it dissolves neither nonpolar sludge nor contaminant (mineral oil and the like) and tends to easily precipitate them in the condensed liquid refrigerant. The precipitate adheres to the cramped portions of a capillary tube, an expansion valve and the like, causing clogging. This consequently causes abnormal stop due to the discharge temperature rise of the compressor and the compressor failure due to the malfunction of the expansion valve, and therefore, it is required to devise sufficient countermeasures.

Moreover, the synthetic oil of ether oil, ester oil or the like is employed as a refrigerating machine oil for this HFC-based refrigerant since mutual solubility with the refrigerant becomes one of important characteristics. However, the synthetic oil, which has a strong polarity, therefore has the property that it easily dissolves the residual impurities other than the refrigerating machine oil and the refrigerant. Therefore, in a refrigeration apparatus that employs a synthetic oil as a refrigerating machine oil, clogging with sludge and the like after the evaporation of the refrigerant tends to easily occur in a decompression mechanism constructed of an electric expansion valve, and this easily causes a problem that abnormality occurs in the refrigeration cycle.

It is often the case where the refrigerant piping is laid in walls in apartment houses and buildings. In the case where the refrigerant piping is laid in walls as described above, the existence of the contaminants of the residual refrigerating machine oil and so on in the existing interconnecting piping emerges as a problem when installing a new air conditioner by removing the existing air conditioner. Particularly when the HFC-based refrigerant is employed as described above, it is required to remove the residual contaminants in this existing interconnecting piping as much as possible. Accordingly, there has been the conventional practice of removing the existing air conditioner, thereafter cleaning the existing interconnecting piping to remove the contaminants including the residual refrigerating machine oil for the securing of cleanliness and thereafter installing a new air conditioner.

However, the conventional method of cleaning the existing interconnecting piping, as described above, has a problem that it needs much labor and time and needs a considerable amount of cost for the installation of a new air conditioner.

DISCLOSURE OF THE INVENTION

This invention has been made to remove the aforementioned conventional drawbacks and has the object of providing a refrigerant and oil collection operating method and refrigerant and oil collection control device, which is able to inexpensively secure cleanliness in the existing interconnecting piping and therefore able to install a new air conditioner at low cost.

Accordingly, the refrigerant and oil collection operating method of this invention is characterized in that, according to a refrigerant and oil collection operating method for collecting a refrigerant in a refrigerant circuit, a refrigerant and oil collection operation is carried out in a state in which the refrigerant is raised in temperature to a temperature not lower than a temperature at which contaminants of a refrigerating machine oil and so on in the refrigerant circuit are dissolved in the refrigerant.

According to the above-mentioned construction, the refrigerant and oil collection operation is carried out in the state in which the refrigerant is raised in temperature to a temperature not lower than the temperature at which the contaminants of the refrigerating machine oil in the refrigerant circuit and so on are dissolved in the refrigerant, and therefore, cleanliness in the left refrigerant piping of, for example, the existing interconnecting piping can be secured.

One embodiment is characterized in that, in an air conditioner having a compressor, a heat source side heat exchanger, a decompression mechanism and a use side heat exchanger, a piping heating operation is carried out in a heating operation mode, and thereafter the refrigerant and oil collection operation for collecting the refrigerant into the heat source side heat exchanger is carried out.

According to this embodiment, by carrying out the piping heating operation in the heating operation mode, the refrigerant and oil collection operation can be carried out in the state in which the refrigerant is raised in temperature to a temperature not lower than the temperature at which the contaminants of the refrigerating machine oil in the refrigerant circuit and so on are dissolved in the refrigerant. Therefore, cleanliness in the left refrigerant piping of, for example, the existing interconnecting piping can be secured.

In this embodiment, it is proper to continue the operation for a prescribed time after the temperature of the piping extended from the compressor to the heat source side heat exchanger becomes equal to or higher than 30° C. or for a prescribed time after the temperature of the use side heat exchanger becomes equal to or higher than 30° C. or for a prescribed time after the temperature of the discharged gas from the compressor becomes equal to or higher than 40° C. Moreover, the time of continuation should preferably be about ten or more minutes. It is to be noted that the piping heating operation can also be continued for a preset prescribed time.

It is preferable to start the refrigerant and oil collection operation before the temperature of the refrigerant is not lowered after the piping heating operation is carried out, i.e., within a prescribed time. In practice, the prescribed time is not longer than 30 minutes.

After the piping heating operation, it is acceptable to carry out the refrigerant and oil collection operation in a cooling operation mode or carry out the refrigerant and oil collection operation in a heating operation mode. When the refrigerant and oil collection operation is carried out in the heating operation mode, no operation mode change is needed. Therefore, in addition to the advantage that the operation can easily be carried out, the refrigerant raised in temperature is collected as it is without being cooled, and this enables the further reduction of the residual volume of the contaminants including the refrigerating machine oil and the impurities of degraded objects, dust and the like.

Furthermore, the refrigerant and oil collection operating method of this invention is a refrigerant and oil collection operating method for collecting refrigerant and oil in a refrigerant circuit, the method including the steps of raising the refrigerant in temperature to a temperature not lower than a temperature at which a refrigerating machine oil in a refrigerant circuit is dissolved in the refrigerant and carrying out a refrigerant and oil collection operation in a state in which the refrigerant is raised in temperature.

According to the above-mentioned construction, the refrigerant and oil collection operation is carried out in the state in which the refrigerant is raised in temperature to a temperature not lower than the temperature at which the refrigerating machine oil in the refrigerant circuit is dissolved in the refrigerant. Therefore, cleanliness in the left refrigerant piping of, for example, the existing interconnecting piping can be secured.

One embodiment is characterized in that the refrigerant and oil are collected into an indoor heat exchanger in the step of carrying out the refrigerant and oil collection operation.

One embodiment is characterized in that the refrigerant and oil are collected from a service port provided for a liquid shutoff valve in the step of carrying out the refrigerant and oil collection operation.

One embodiment is characterized by including the steps of carrying out a piping heating operation in a heating operation mode and carrying out a collection operation for collecting the refrigerant and oil into the heat source side heat exchanger after the piping heating operation ends in an air conditioner, which has a compressor, a heat source side heat exchanger, a decompression mechanism and a use side heat exchanger.

According to this embodiment, by carrying out the piping heating operation in the heating operation mode, the refrigerant and oil collection operation can be carried out in the state in which the refrigerant is raised in temperature to a temperature not lower than the temperature at which the refrigerating machine oil in the refrigerant circuit is dissolved in the refrigerant. Therefore, cleanliness in the left refrigerant piping of, for example, the existing interconnecting piping can be secured.

One embodiment is characterized in that the collection operation, which is carried out after the piping heating operation, is carried out in the cooling operation mode.

According to this embodiment, the refrigerant and oil can be collected into the outdoor heat exchanger with good workability by a pump-down operation for collecting the liquid refrigerant into the outdoor heat exchanger through the cooling operation with the closed liquid shutoff valve.

A refrigerant and oil collection operating method of this invention includes the steps of switching an operation mode to a heating operation mode, operating a compressor at a maximum rotating speed, stopping the compressor for pressure equalization after a lapse of a prescribed time, switching the operation mode to a cooling operation mode and closing a liquid shutoff valve and collecting a refrigerant and oil into a heat source side heat exchanger by operating the compressor.

According to this embodiment, the piping heating operation can be carried out in the heating operation mode, and the refrigerant and oil collection operation can be carried out in the cooling operation mode with good workability.

A refrigerant and oil collection control device of this invention controls an air conditioner having a compressor, a four-way changeover valve, an outdoor heat exchanger, a decompression mechanism, an indoor heat exchanger and a liquid shutoff valve sequentially through the steps of switching the four-way changeover valve to a heating operation mode, operating the compressor at a maximum rotating speed, stopping the compressor after a lapse of a prescribed time, switching the four-way changeover valve to a cooling operation mode, closing the liquid shutoff valve and operating the compressor, whereby a collection operation of a refrigerant and oil into the outdoor heat exchanger is carried out.

According to the above-mentioned construction, the refrigerant and oil can be collected by the pump-down operation in the state in which the refrigerant is raised in temperature to a temperature not lower than the temperature at which the refrigerating machine oil in the refrigerant circuit is dissolved in the refrigerant, and cleanliness in the refrigerant piping of, for example, the existing interconnecting piping can be secured.

BEST MODE FOR CARRYING OUT THE INVENTION

Concrete embodiments of the refrigerant and oil collection operating method and refrigerant and oil collection control device of this invention will be described in detail next with reference to the drawings.

Figure 1:
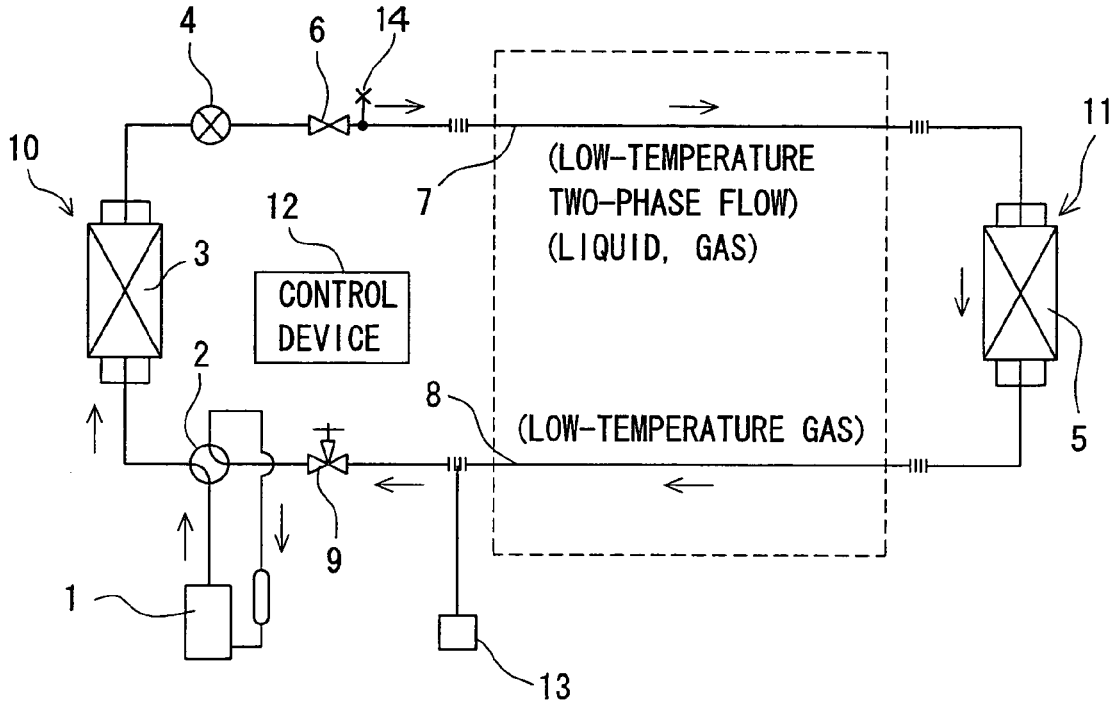
FIG. 1 is a refrigerant circuit diagram during the cooling operation of an air conditioner, for explaining a refrigerant and oil collection operating method according to an embodiment of this invention.

First of all, the present inventor paid attention to the refrigerant and oil collection operation (pump-down operation) and examined how the residual refrigerating machine oil content changed by this refrigerant and oil collection operation. This residual refrigerating machine oil becomes a contaminant for a new air conditioner together with oils other than the refrigerating machine oil, moisture, air, wear metal powders, dust and so on. Simply explaining the normal refrigerant and oil collection operation, as shown in FIG. 1, in an air conditioner in which a refrigerant circuit is constructed by connecting the discharge side and the suction side of a compressor 1 to the primary ports of a four-way changeover valve 2 and serially connecting an outdoor heat exchanger 3, an electric expansion valve 4 and an indoor heat exchanger 5 to the secondary ports of the four-way changeover valve 2, this operation is to carry out a cooling operation in a state in which a liquid shutoff valve 6 is closed and collects liquid refrigerant into the outdoor heat exchanger 3. In FIG. 1, reference numerals 7 and 8 denote interconnecting pipes for connecting an outdoor unit 10 with an indoor unit 11, and the pipes are usually laid in the walls or ceiling surfaces in apartment houses, buildings and the like. Then, it was examined that, after the refrigerant and oil collection operation as described above was carried out, the extent to which the refrigerating machine oil remained as a residual contaminant in the interconnecting pipes 7 and 8.

Figure 5:
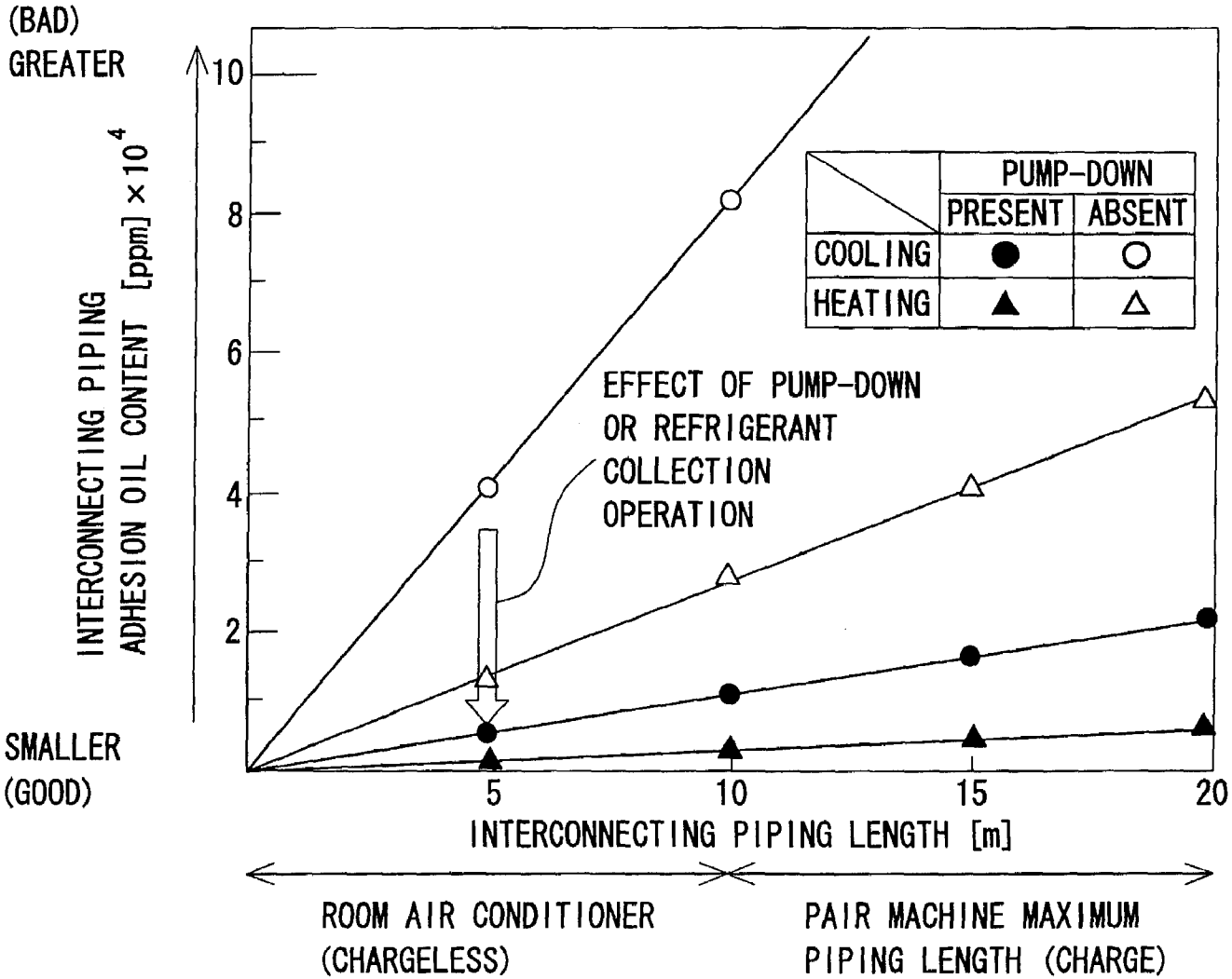
FIG. 5 is a graph showing the residual refrigerating machine oil content in the existing interconnecting piping in relation to the presence or absence of the refrigerant and oil collection operation and the immediately preceding operating state.

The results are shown in FIG. 5. In the figure, the residual refrigerating machine oil content in the interconnecting pipes 7 and 8 is shown by comparison between the case where the refrigerant and oil collection operation is carried out and the case where the operation is not carried out. In addition, the residual refrigerating machine oil content is shown by comparison between the case where the immediately preceding operation mode is the cooling operation mode and the case where the mode is the heating operation mode. Then, the following facts were discovered from the figure. First, if the refrigerant and oil collection operation is carried out, then the residual refrigerating machine oil is largely decreased regardless of the operation mode. Secondly, if a comparison is made between the case of the cooling operation mode and the case of the heating operation mode, then the residual refrigerating machine oil content is largely decreased in the heating operation mode in either of the case where the refrigerant and oil collection operation is carried out and the case where the operation is not carried out. These facts make it clear that the residual refrigerating machine oil content and impurities decrease most when the immediately preceding operation mode is the heating operation mode and the refrigerant and oil collection operation is carried out.

Figure 2:
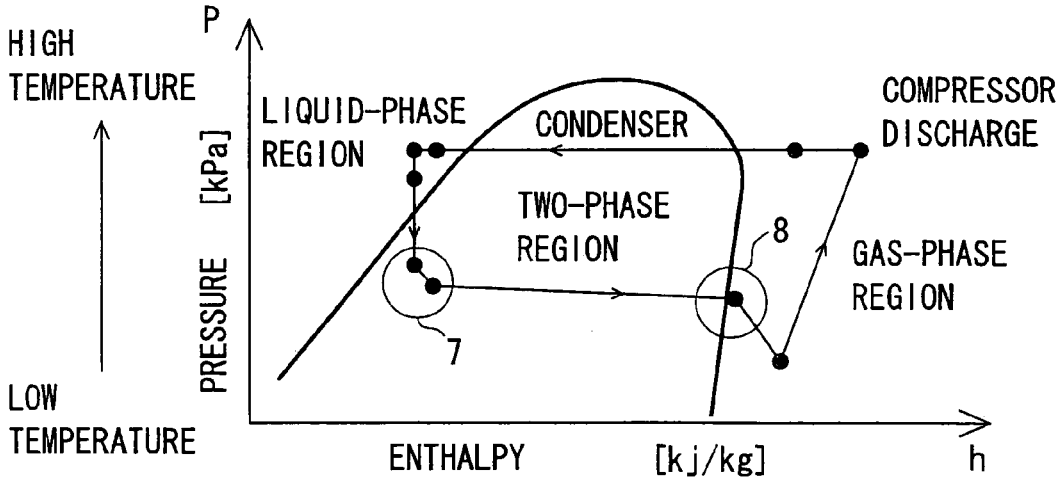
FIG. 2 is a Mollier diagram during the cooling operation, for explaining the operating state of the above air conditioner.

Next, it was examined why the residual refrigerating machine oil content decreased when the immediately preceding operation mode was the heating operation mode. First of all, in the cooling operation mode, the outdoor heat exchanger 3 functions as a condenser, and the indoor heat exchanger 5 functions as an evaporator. At this time, in the interconnecting pipes 7 and 8, as is apparent from the Mollier diagram of FIG. 2, a low-temperature gas-liquid-mixture two-phase flow flows through the interconnecting pipe 7 located on the inlet side of the indoor heat exchanger 5, and a low-temperature gaseous refrigerant flows through the interconnecting pipe 8 located on the outlet side. On the other hand, in the heating operation mode, as shown in the refrigerant circuit diagram of FIG. 3 and the Mollier diagram of FIG. 4, a high-temperature gaseous refrigerant flows through the interconnecting pipe 8 located on the inlet side of the indoor heat exchanger 5 that functions as a condenser, and a high-temperature liquid refrigerant flows through the interconnecting pipe 7 located on the outlet side.

The refrigerating machine oil has a property that it easily dissolves in the refrigerant at a higher temperature than a lower temperature and more easily dissolves in the liquid refrigerant than in the gaseous refrigerant. Therefore, when the heating operation has been carried out immediately before the refrigerant and oil collection operation, a greater amount of refrigerating machine oil has been dissolved in the refrigerant than when the cooling operation has been carried out. Therefore, this refrigerating machine oil is collected with the refrigerant and oil collection operation, and this consequently reduces the residual refrigerating machine oil content in the interconnecting pipes 7 and 8. The following embodiments are based on the knowledge as described above.

(First Embodiment)

Figure 3:
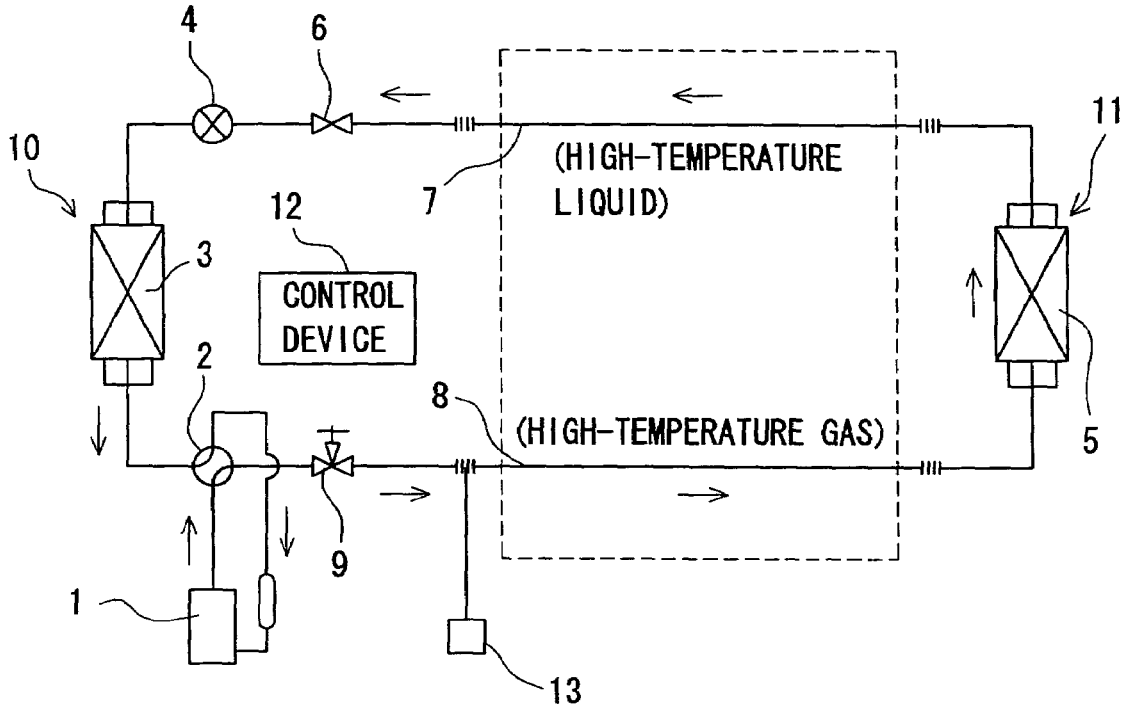
FIG. 3 is a refrigerant circuit diagram during the heating operation of the air conditioner, for explaining the refrigerant and oil collection operating method of the embodiment of this invention.
Figure 4:
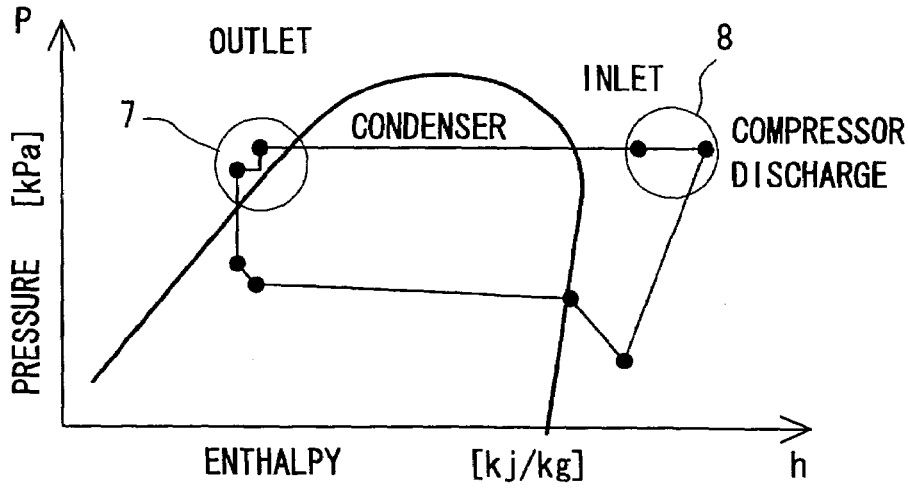
FIG. 4 is a Mollier diagram during the heating operation, for explaining the operating state of the above air conditioner.
Figure 6:
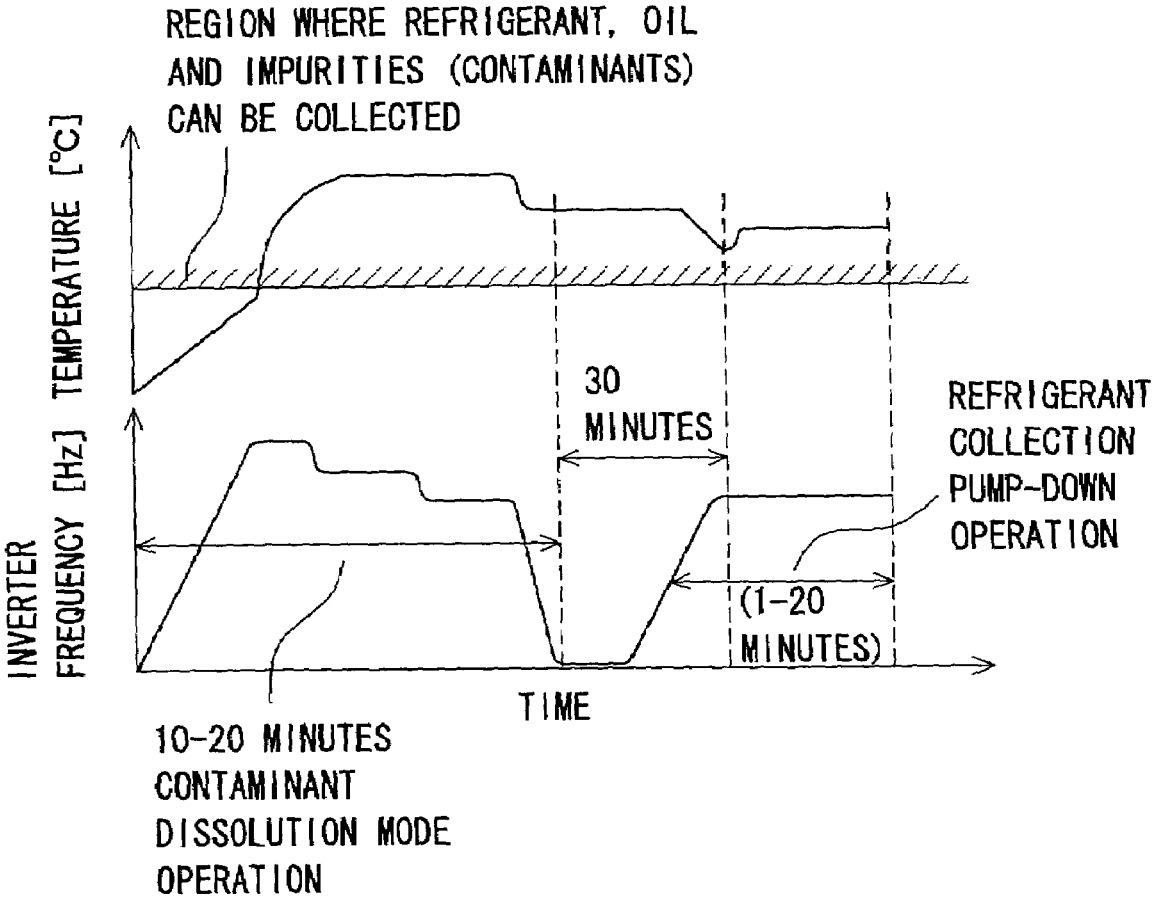
FIG. 6 is a timing chart for explaining the refrigerant and oil collection operating method of the embodiment of this invention.

Description will be first made on the assumption that the air conditioner shown in FIG. 1 and FIG. 3 is the existing one. When carrying out the refrigerant and oil collection operation of the existing air conditioner, the four-way changeover valve 2 is first switched to the heating operation mode, and the heating operation (piping heating operation) is carried out. As shown in FIG. 6, this heating operation is carried out for about 10 minutes to 20 minutes. When the heating operation is started, the temperatures of the indoor heat exchanger (use side heat exchanger) 5, which functions as a condenser, and the interconnecting pipes 7 and 8 around it gradually rise. Then, a state in which the temperature of the indoor heat exchanger 5 becomes equal to or higher than 30° C. is secured for ten or more minutes, and the heating operation is ended. As described above, the state in which the temperature of the indoor heat exchanger 5 becomes equal to or higher than 30° C. is the state in which the refrigerant temperature is raised to a temperature not lower than a temperature at which the refrigerating machine oil and other contaminants in the refrigerant circuit are dissolved in the refrigerant. Then, the refrigerant and oil collection operation is started in a stage as early as possible before the refrigerant temperature is not lowered, or within, for example, 30 minutes after the end of this heating operation. That is, the cooling operation is carried out in a state in which the four-way changeover valve 2 is switched to the cooling operation mode and the liquid shutoff valve 6 is closed, and the refrigerant is collected into the outdoor heat exchanger (heat source side heat exchanger) 3. This refrigerant and oil collection operation, which is similar to the well-known pump-down operation, is carried out for about 1 to 20 minutes.

Figure 7:
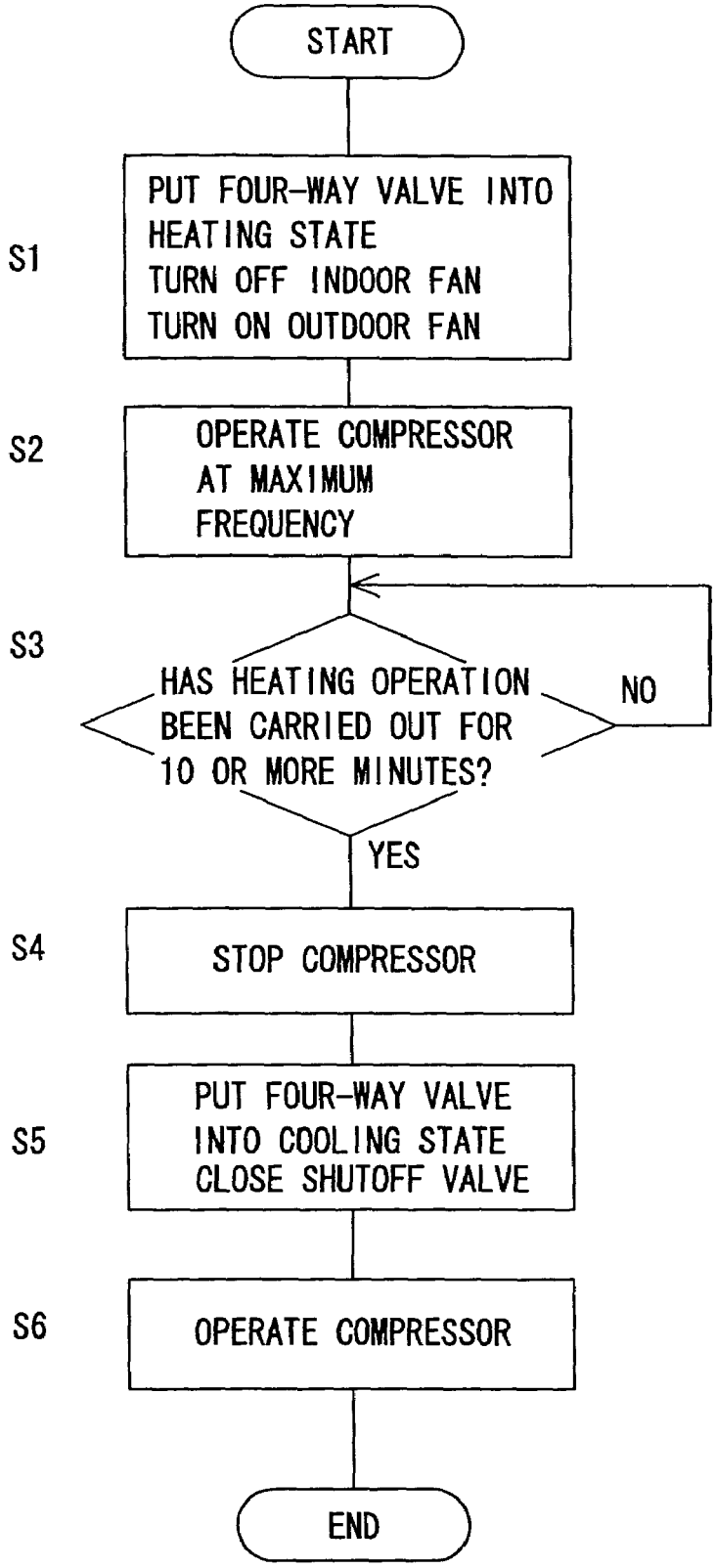
FIG. 7 is a flow chart of the refrigerant and oil collection processing operation carried out under the control of the control device of FIG. 1 and FIG. 3.

FIG. 7 is a flow chart of the refrigerant and oil collection processing operation to be carried out under the control of the control device 12 shown in FIG. 1 and FIG. 3. In step S1, the four-way changeover valve 2 is switched to the heating operation mode. In the above case, it is desirable to turn off an indoor fan (not shown) and turn on an outdoor fan (not shown). In step S2, the compressor 1 is operated. In the above case, in order to get rid of the separated state of the liquid by making the refrigerating machine oil easily dissolve in the refrigerant, sensible heat is maximized by operating the compressor 1 at a maximum rotating speed. In step S3, it is determined whether ten or more minutes have elapsed in a state in which the temperature of the indoor heat exchanger 5 becomes equal to or higher than 30° C. As a result, if ten or more minutes have elapsed, then the program flow proceeds to step S4. In step S4, the compressor 1 is temporarily stopped for pressure equalization. This stop of the compressor 1 should preferably be within, for example, 30 minutes so that the refrigerant temperature should not be lowered. In step 5, the four-way changeover valve 2 is switched to the cooling operation mode. Moreover, the liquid shutoff valve 6 is closed. In step S6, the compressor 1 is operated to collect the refrigerant and oil into the outdoor heat exchanger (heat source side heat exchanger) 3, and thereafter, the refrigerant and oil collection operation is ended.

The end of the collection of the refrigerant and oil in the above case is determined on the basis of time (two minutes to three minutes) and signals that represent the temperature and pressure (vacuum pressure) from sensors 13 such as a temperature sensor and a pressure sensor provided in a service port.

According to the aforementioned refrigerant and oil collection operating method, the refrigerant and oil collection operation is carried out in the state in which the refrigerant temperature is raised to a temperature not lower than the temperature at which the refrigerating machine oil and the contaminants in the refrigerant circuit are dissolved in the refrigerant. Therefore, cleanliness in the left refrigerant piping, or in particular, the interconnecting pipes 7 and 8 can be secured. Accordingly, there is no need for cleaning the inside of the existing interconnecting pipes 7 and 8 even when a new air conditioner is installed after carrying out the refrigerant and oil collection operation of the existing air conditioner as described above, dissimilarly to the conventional case. The existing interconnecting pipes 7 and 8 can be utilized as they are as interconnecting pipes for the new air conditioner, and therefore, the installation cost of the new air conditioner can be remarkably reduced.

In the above description, the refrigerant and oil collection operation is carried out after the state in which the temperature (condenser temperature) of the indoor heat exchanger 5 becomes equal to or higher than 30° C. is secured for ten or more minutes. However, with regard to this temperature, it is ideally preferable to detect the temperature of the refrigerant piping extended from the indoor heat exchanger 5 to the outdoor heat exchanger 3 and provide a state in which the lowest temperature becomes equal to or higher than 30° C. Practically, it is acceptable to detect the temperature of any portion of the refrigerant piping extended from the compressor 1 to the indoor heat exchanger 5 or regard a state in which the discharge temperature (presumed temperature according to a detected temperature or a detected pressure of a discharge pipe) of the compressor 1 becomes equal to or higher than 40° C. as an elevated temperature state of the refrigerant. Furthermore, at the time of service and installation work, it is acceptable to regard a state in which an equivalent saturation temperature by pressure measurement utilizing the service port provided for the liquid shutoff valve 6 or the gas shutoff valve 9 is not lower than 30° C. as an elevated temperature state of the refrigerant.

In the existing air conditioner to be subjected to the refrigerant and oil collection operation by the aforementioned method, there are normally employed refrigerants of R22 in the case of a room air conditioner and a packaged air conditioner, R502 in the case of a cryogenic air conditioner, and R12 and R22 in the case of a large-scale chiller type air conditioner. Moreover, there is employed mineral oil (SUNISO oil, alkylbenzene oil, or blended oil of these oils) as refrigerating machine oil. On the other hand, in the air conditioner to be newly installed, there are employed refrigerants of R410A, R407C, and R32 or a mixed -refrigerant that contains at least 60 percent or more by weight of R32 in the case of a room air conditioner and a packaged air conditioner, R404A in the case of a cryogenic air conditioner and R134a, R404A and R407C in the case of a large-scale chiller type air conditioner. Moreover, there is mainly employed synthetic oil (ether oil, ester oil, alkylbenzene oil, blended oil of two kinds of three kinds of these oils, mineral oil, or blended oil of mineral oil and two kinds or three kinds of the above oils) as refrigerating machine oil. When the HFC-based refrigerant is employed as described above, the residual contaminants in this existing interconnecting piping are required to be removed as much as possible. Accordingly, if the aforementioned refrigerant and oil collection operating method is carried out, then it is enabled to restrain the occurrence of the problem that clogging with sludge (dust and degraded objects) and the like after the evaporation of the refrigerant occurs in the decompression mechanism constructed of the electric expansion valve 4 or a capillary tube and abnormality occurs in the refrigeration cycle due to this. In other words, it is enabled to restrain the occurrence of abnormal stop due to the temperature rise of the discharge gas from compressor 1 and the occurrence of failure of the compressor 1 due to the malfunction of the expansion valve 4.

(Second Embodiment)

The refrigerant and oil collection operating method of the second embodiment will be described next. This is to carry out the refrigerant and oil collection operation for collecting the refrigerant still in the heating operation mode instead of collecting the refrigerant in the cooling operation mode after the end of the heating operation (piping heating operation) in the aforementioned first embodiment. In this case, the liquid shutoff valve 6 is provided with a service port 14 and the liquid refrigerant condensed by the indoor heat exchanger 5 is collected from this service port into a collecting vessel or the like. Moreover, it is acceptable to collect the refrigerant not from the service port but into the indoor heat exchanger 5 that is functioning as a condenser. With regard to the conditions of temperature, time and so on concerning the heating operation, the time to the start of the refrigerant and oil collection operation and so on are similar to those of the aforementioned first embodiment. According to this embodiment, in addition to the operation and effects obtained similarly to those of the aforementioned first embodiment, there is no need for operation mode change. Therefore, in addition to the advantage that the embodiment can easily be implemented, the refrigerant raised in temperature is collected as it is without being cooled. This also brings the advantage that the residual volume of the contaminants including the refrigerating machine oil can be reduced.

The concrete embodiments of this invention have been described above. However, this invention is not limited to the aforementioned embodiments, and it is possible to put a variety of modifications into practice within the scope of this invention. For example, according to the above description, the invention is suitable for the case where the existing air conditioner employs the HCFC-based refrigerant and the mineral oil and the air conditioner to be newly installed employs the HFC-based refrigerant and the synthetic oil. However, the invention is also suitable for the case where the existing air conditioner employs the HFC-based refrigerant and the synthetic oil and the air conditioner to be newly installed employs the HFC-based refrigerant and the synthetic oil. The invention can also be applied to the case where both the existing air conditioner and the air conditioner to be newly installed employ the HCFC-based refrigerant and the mineral oil. It is preferable to change the conditions of temperature, time and so on concerning the heating operation (piping heating operation), the time to the start of the refrigerant and oil collection operation and so on according to the types of the refrigerant and the refrigerating machine oil employed in the existing air conditioner and the ambient temperature of outside air temperature and the like. The reason why the refrigerating machine oil is enumerated as a representative example of the contaminants is that the refrigerating machine oil employed in the existing air conditioner (apparatus for carrying out the oil collection operation) is regarded as an impurity when viewed from the air conditioner to be newly installed in the case where the new air conditioner is installed by removing the existing air conditioner with the interconnecting piping left behind.

The invention claimed is:

1. A refrigerant and oil collection operating method for collecting a refrigerant in a refrigerant circuit of an air conditioner having a compressor, a heat source side heat exchanger, a decompression mechanism and use side heat exchanger, said method comprising the step of carrying out a piping heating operation in a heating operation mode so that the refrigerant is heated at a temperature sufficient for contaminants including a refrigerating machine oil in the refrigerant circuit to be dissolved, thereafter carrying out a refrigerant and oil collection operation for collecting the refrigerant into the heat source side heat exchanger, and further comprising the step of continuing the piping heating operation for a prescribed time after a temperature of piping extending from the compressor to the heat source side heat exchanger becomes equal to or higher than 30° C.

2. A refrigerant and oil collection operating method for collecting a refrigerant in a refrigerant circuit of an air conditioner having a compressor, a heat source side heat exchanger, a decompression mechanism and use side heat exchanger, said method comprising the step of carrying out a piping heating operation in a heating operation mode so that the refrigerant is heated at a temperature sufficient for contaminants including a refrigerating machine oil in the refrigerant circuit to be dissolved, thereafter carrying out a refrigerant and oil collection operation for collecting the refrigerant into the heat source side heat exchanger, and further comprising the step of continuing the piping heating operation for a prescribed time after a temperature of the use side heat exchanger becomes equal to or higher than 30° C.

3. A refrigerant and oil collection operating method for collecting a refrigerant in a refrigerant circuit of an air conditioner having a compressor, a heat source side heat exchanger, a decompression mechanism and use side heat exchanger, said method comprising the step of carrying out a piping heating operation in a heating operation mode so that the refrigerant is heated at a temperature sufficient for contaminants including a refrigerating machine oil in the refrigerant circuit to be dissolved, thereafter carrying out a refrigerant and oil collection operation for collecting the refrigerant into the heat source side heat exchanger, and further comprising the step of continuing the piping heating operation for a prescribed time after a temperature of discharged gas from the compressor becomes equal to or higher than 40° C.

4. The refrigerant and oil collection operating method as claimed in claim 1, wherein the prescribed time is not shorter than about ten minutes.

5. A refrigerant and oil collection operating method for collecting a refrigerant in a refrigerant circuit of an air conditioner having a compressor, a heat source side heat exchanger, a decompression mechanism and use side heat exchanger, said method comprising the step of carrying out a piping heating operation in a heating operation mode so that the refrigerant is heated at a temperature sufficient for contaminants including a refrigerating machine oil in the refrigerant circuit to be dissolved, thereafter carrying out a refrigerant and oil collection operation for collecting the refrigerant into the heat source side heat exchanger, and further comprising the step of continuing the piping heating operation for a preset prescribed time.

6. A refrigerant and oil collection operating method for collecting a refrigerant in a refrigerant circuit of an air conditioner having a compressor, a heat source side heat exchanger, a decompression mechanism and use side heat exchanger, said method comprising the step of carrying out a piping heating operation in a heating operation mode so that the refrigerant is heated at a temperature sufficient for contaminants including a refrigerating machine oil in the refrigerant circuit to be dissolved, thereafter carrying out a refrigerant and oil collection operation for collecting the refrigerant into the heat source side heat exchanger, and further comprising the step of starting the refrigerant and oil collection operation within a prescribed time after the piping heating operation is carried out.

7. The refrigerant and oil collection operating method as claimed in claim 6, wherein the prescribed time is not longer than 30 minutes.

8. A refrigerant and oil collection operating method for collecting a refrigerant in a refrigerant circuit of an air conditioner having a compressor, a heat source side heat exchanger, a decompression mechanism and a use side heat exchanger, the method comprising a step of carrying out a piping heating operation in a heating operation mode so that the refrigerant is heated at a temperature sufficient for refrigerating machine oil in the refrigerant circuit to be dissolved, and thereafter carrying out a refrigerant and oil collection operation for collecting the refrigerant into an indoor heat exchanger.

9. A refrigerant and oil collection operating method for collecting a refrigerant in a refrigerant circuit of an air conditioner having a compressor, a heat source side heat exchanger, a decompression mechanism and a use side heat exchanger, the method comprising a step of carrying out a piping heating operation in a heating operation mode so that the refrigerant is heated at a temperature sufficient for a refrigerating machine oil in the refrigerant circuit to be dissolved, and thereafter carrying out a refrigerant and oil collection operation for collecting the refrigerant and oil from a service port provided for a liquid shutoff valve.

10. A refrigerant and oil collection operating method comprising the steps of:

switching an operation mode to a heating operation mode;

operating the compressor at a maximum rotating speed;

stopping the compressor for pressure equalization after a lapse of a prescribed time;

switching the operation mode to a cooling operation mode and closing a liquid shutoff valve; and collecting a refrigerant and oil into a heat source side heat exchanger by operating the compressor.

11. A refrigerant and oil collection control device for controlling an air conditioner having a compressor, a four-way changeover valve, an outdoor heat exchanger, a decompression mechanism, an indoor heat exchanger and a liquid shutoff valve sequentially through the steps of:

switching the four-way changeover valve to a heating operation mode;

operating the compressor at a maximum rotating speed;

stopping the compressor after a lapse of a prescribed time;

switching the four-way changeover valve to a cooling operation mode;

closing the liquid shutoff valve; and operating the compressor, whereby a collection operation of a refrigerant and oil into the outdoor heat exchanger is carried out.

* * * * *

UNITED STATES PATENT AND TRADEMARK OFFICE

CERTIFICATE OF CORRECTION

PATENT NO. : 7,178,347 B2
APPLICATION NO. : 10/258793
DATED : February 20, 2007
INVENTOR(S) : Shigeharu Taira et al.

It is certified that error appears in the above-identified patent and that said Letters Patent is hereby corrected as shown below:

Please add the following information under "[22]"

--[30] Foreign Application Priority Data

April 28, 2000 [JP] Japan.....2000-130635--

Signed and Sealed this

Twenty-first Day of August, 2007

JON W. DUDAS
*Director of the United States Patent and Trademark Office*